US010604362B2

(12) United States Patent
Kurotobi

(10) Patent No.: US 10,604,362 B2
(45) Date of Patent: Mar. 31, 2020

(54) MEDIUM PROCESSING DEVICE

(71) Applicant: SEIKO EPSON CORPORATION, Tokyo (JP)

(72) Inventor: Shuhei Kurotobi, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 16/184,401

(22) Filed: Nov. 8, 2018

(65) Prior Publication Data

US 2019/0144222 A1 May 16, 2019

(30) Foreign Application Priority Data

Nov. 13, 2017 (JP) ..... 2017-218020

(51) Int. Cl.

| | |
|---|---|
| ***B65H 1/24*** | (2006.01) |
| ***B65H 31/26*** | (2006.01) |
| ***B65H 31/02*** | (2006.01) |
| ***B65H 1/02*** | (2006.01) |

(52) U.S. Cl.

CPC ..... *B65H 1/24* (2013.01); *B65H 1/02* (2013.01); *B65H 31/02* (2013.01); *B65H 31/26* (2013.01); *B65H 2301/321* (2013.01); *B65H 2301/4214* (2013.01); *B65H 2405/214* (2013.01); *B65H 2701/1912* (2013.01)

(58) Field of Classification Search

CPC ... B65H 1/16; B65H 1/20; B65H 1/14; B65H 1/12; B65H 1/08; B65H 1/02; B65H 1/022; B65H 1/18; B65H 2511/152; B65H 2405/20; B65H 2405/21; B65H 2405/214; B65H 1/027; B65H 1/025

See application file for complete search history.

(56) References Cited

U.S. PATENT DOCUMENTS

| | | | | |
|---|---|---|---|---|
| 5,088,718 A * | 2/1992 | Stepan | B65H 1/02 271/121 |
| 5,954,226 A * | 9/1999 | Peterson | A47F 1/06 221/59 |
| 7,823,872 B2 * | 11/2010 | Sasaki | B65H 1/025 271/126 |
| 2007/0065202 A1 | 3/2007 | Tokuno | |

(Continued)

FOREIGN PATENT DOCUMENTS

| | | |
|---|---|---|
| JP | S52-068234 | 5/1977 |
| JP | 2005-096964 A | 4/2005 |

(Continued)

OTHER PUBLICATIONS

European Search Report issued in European application No. 18206027.7 dated Apr. 12, 2019.

*Primary Examiner* — Jeremy R Severson

(74) *Attorney, Agent, or Firm* — Foley & Lardner LLP

(57) ABSTRACT

A medium processing device includes a medium storage portion configured to stack sheet-shaped media to store the sheet-shaped media, a first pressurizing member configured to pressurize the sheet-shaped media stored in the medium storage portion, and a second pressurizing member configured to pressurize the sheet-shaped media in cooperation with the first pressurizing member when a stacking thickness of the sheet-shaped media stored in the medium storage portion is equal to or greater than a predetermined thickness.

14 Claims, 6 Drawing Sheets

(56) References Cited

U.S. PATENT DOCUMENTS

| | | | | |
|---|---|---|---|---|
| 2009/0027733 | A1* | 1/2009 | Uehara ..... | B65H 31/06<br>358/406 |
| 2010/0014130 | A1 | 1/2010 | Natsuno et al. | |
| 2014/0292974 | A1 | 10/2014 | Kodama et al. | |

FOREIGN PATENT DOCUMENTS

| | | | |
|---|---|---|---|
| JP | 2006-096545 | A | 4/2006 |
| JP | 2006-103839 | A | 4/2006 |
| JP | 2007-022799 | A | 2/2007 |
| JP | 2008-207953 | A | 9/2008 |
| JP | 2010-026682 | A | 2/2010 |

* cited by examiner

MEDIUM PROCESSING DEVICE

BACKGROUND

1. Technical Field

The invention relates to a medium processing device.

2. Related Art

In the related art, there is known a sheet-shaped medium processing device which includes a conveyance path for conveying a sheet-shaped medium on which magnetic ink characters are printed, an image reading head for reading an image on the sheet-shaped medium conveyed through the conveyance path, a magnetic head for reading the magnetic ink characters on the sheet-shaped medium conveyed through the conveyance path, and a discharge portion to which the sheet-shaped medium, after passing through the conveyance path, is discharged (for example, see JP-A-2010-26682).

Note that, a pressing plate for pressurizing, in one direction, the sheet-shaped medium conveyed, is provided to the discharge portion of the above-described device.

However, when sheet-shaped media conveyed to and stacked on the discharge portion of the above-described device is increased in a total stacking thickness, the entire stacked sheet-shaped media may not be securely pressurized. Accordingly, for example, a position of an upper-most sheet-shaped medium of the sheet-shaped media stacked on the discharge portion is deviated, and a trailing edge of the sheet-shaped medium and a leading edge of a newly-conveyed sheet-shaped medium may collide with each other to cause a medium jam.

SUMMARY

The invention is made to address at least some of the above-described issues and can be realized as the following exemplary embodiments and application examples.

Application Example 1

A medium processing device according to the application example includes a medium storage portion configured to stack sheet-shaped media to store the sheet-shaped media, a first pressurizing member configured to pressurize the sheet-shaped media stored in the medium storage portion, and a second pressurizing member configured to pressurize the sheet-shaped media in cooperation with the first pressurizing member when a stacking thickness of the sheet-shaped media stored in the medium storage portion is equal to or greater than a predetermined thickness.

With this configuration, when the stacking thickness of the sheet-shaped media stored in the medium storage portion is equal to or greater than the predetermined thickness, the first pressurizing member and the second pressurizing member cooperate to pressurize the sheet-shaped media. That is, a pressurizing force for pressurizing the sheet-shaped media can be increased in a stepwise manner according to the stacking thickness of the sheet-shaped media. Thus, when the stacking thickness of the sheet-shaped media stored in the medium storage portion is relatively thin, the sheet-shaped media are pressurized with a relatively smaller pressurizing force. As a result, occurrence of a medium jam caused by buckling and the like of the sheet-shaped media can be suppressed. Meanwhile, when the stacking thickness of the sheet-shaped media stored in the medium storage portion becomes thick, a heavier load is applied to the entire sheet-shaped media. As a result, the sheet-shaped media can be securely stored in the medium storage portion. Therefore, occurrence of a medium jam of the sheet-shaped media in the medium storage portion can be suppressed.

Application Example 2

In the medium processing device according to the above-described application example, the first pressurizing member and the second pressurizing member are arranged on the same axial center, and the first pressurizing member and the second pressurizing member are each arranged at different positions in an axial direction of the axial center.

With this configuration, the first pressurizing member and the second pressurizing member are arranged on the same axial center. Thus, the device configuration can be reduced in size or simplified.

Application Example 3

In the medium processing device according to the above-described application examples, for a state in which the sheet-shaped media are not stored in the medium storage portion, the second pressurizing member is arranged in a stacking direction in which the sheet-shaped media are stacked in the medium storage portion with respect to the first pressurizing member.

With this configuration, arrangement positions of the first pressurizing member and the second pressurizing member are different for the state in which the sheet-shaped media are not stored in the medium storage portion. Accordingly, when the stacking thickness of the sheet-shaped media stored in the medium storage portion is equal to or greater than the predetermined thickness, the first pressurizing member and the second pressurizing member can cooperate efficiently.

Application Example 4

In the medium processing device according to the above-described application examples, the medium processing device further includes a third pressurizing member configured to pressurize the sheet-shaped media on a downstream side in a storage direction of the sheet-shaped media with respect to the first pressurizing member and the second pressurizing member.

With this configuration, the number of positions at which the sheet-shaped media stored in the medium storage portion are pressurized is increased. Thus, the entire sheet-shaped media can be pressurized more securely. Thus, a medium jam can further be suppressed.

BRIEF DESCRIPTION OF THE DRAWINGS

The invention will be described with reference to the accompanying drawings, wherein like numbers reference like elements.

DESCRIPTION OF EXEMPLARY EMBODIMENTS

Exemplary embodiments of the invention will be described below with reference to the accompanying drawings.

First, description is made of a configuration of a medium processing device.

Figure 1:
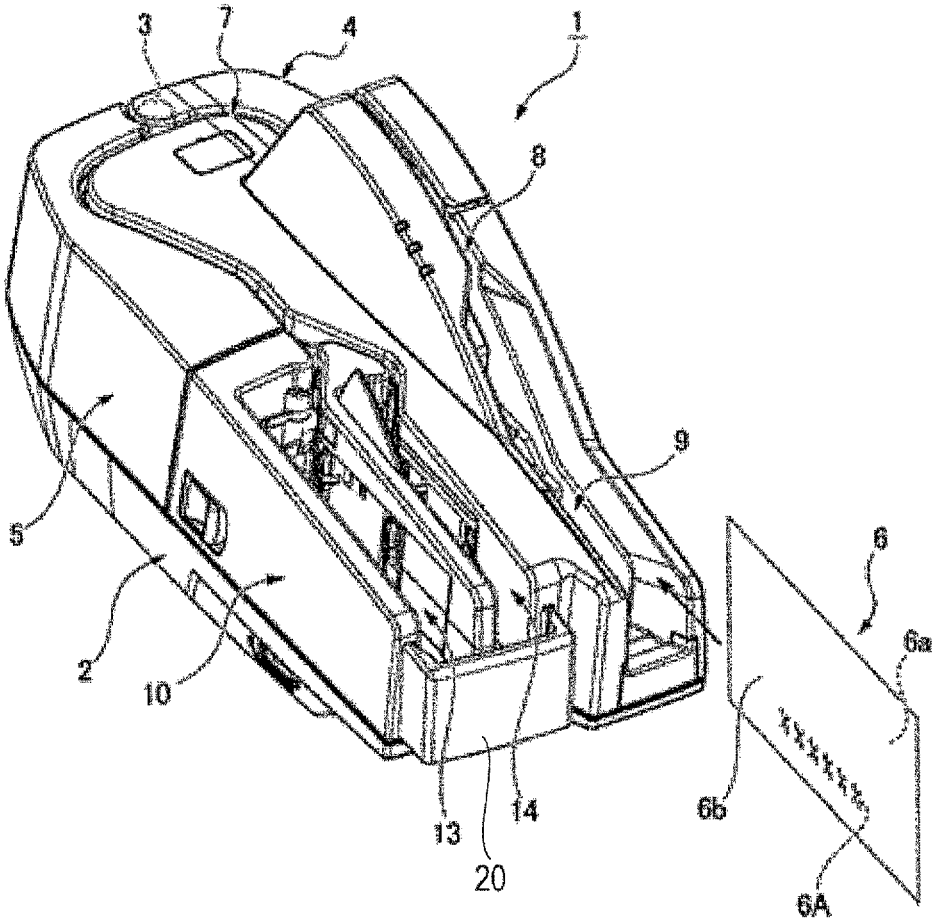
FIG. 1 is a perspective view illustrating a configuration of a medium processing device.
Figure 2:
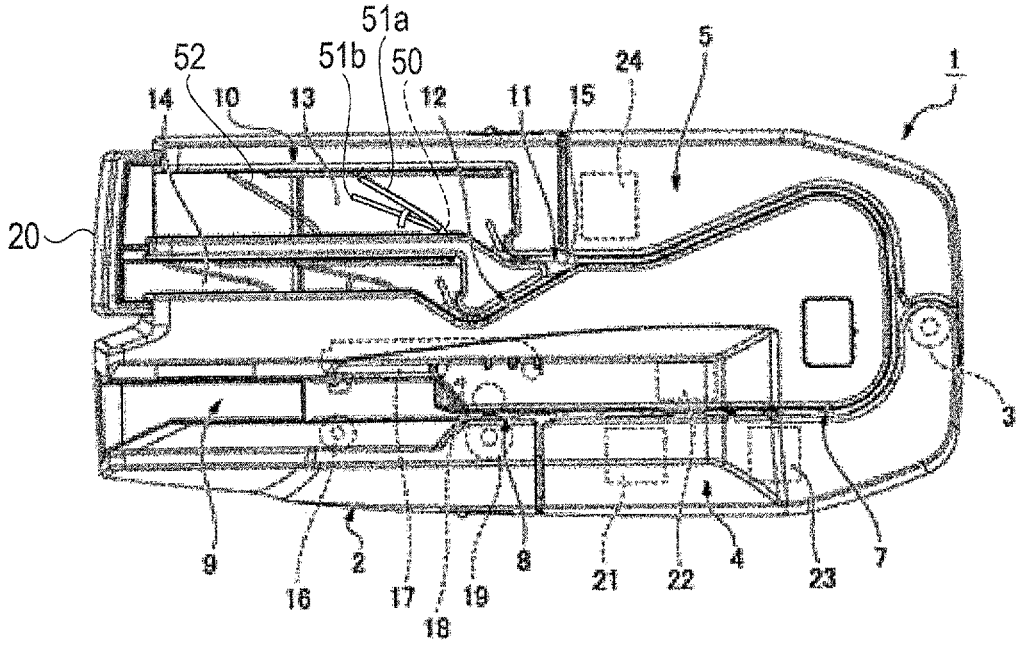
FIG. 2 is a plan view illustrating a configuration of a medium processing device.

FIG. 1 is a perspective view illustrating the configuration of the medium processing device, and FIG. 2 is a plan view illustrating the configuration of the medium processing device. Note that, in the exemplary embodiment, as an example of the medium processing device, description is made of a configuration of a check processing device configured to process a check as a sheet-shaped medium.

As illustrated in FIG. 1 and FIG. 2, a check processing device 1 includes a body case 2 on a device body side and opening/closing covers 4 and 5, which are openable and closeable rightward and leftward (clockwise and anticlockwise) about a vertical shaft 3 serving as a center and mounted at a distal end of the body case 2. A check conveyance path 7 for conveying a check 6 is formed between the body case 2 and the opening/closing covers 4 and 5. The check conveyance path 7 is defined by a narrow vertical groove extending and curving in a substantially U-shape when viewed from top. An upstream end of the check conveyance path 7 in a check conveyance direction couples to a check supply portion 9 formed of a wide vertical groove through a check delivery passage 8 formed of a narrow vertical groove. A downstream end of the check conveyance path 7 couples to a check storage portion 10 serving as a medium storage portion. The check storage portion 10 includes a first branching passage 11, a second branching passage 12, a first storage pocket (medium storage portion) 13, a second storage pocket 14, and a switching lever 15. The first branching passage 11 and the second branching passage 12 couple to the downstream end of the check conveyance path 7, and are formed of narrow vertical grooves. The first storage pocket 13 and the second storage pocket 14 couple to downstream ends of the first branching passage 11 and the second branching passage 12. The switching lever 15 switches discharging of the check 6 to the storage pocket 13 or the storage pocket 14.

As illustrated in FIG. 1, on the check 6, a magnetic ink character string 6A is printed on a lower end part of a front surface 6*a* in a longitudinal direction of the check 6. Further, a payment amount, a drawer of the check, numbers, a signature, and the like are included on the front surface 6*a* with a background having a predetermined pattern, and an endorsement area is provided on a back surface 6*b*. The check 6 is aligned in an up-and-down direction, and is inserted in the check supply portion 9 so that the front surface 6*a* is oriented outward in the check conveyance path 7 having a U-shape.

A check delivery mechanism is incorporated in the check supply portion 9. The check delivery mechanism delivers a bundle of the inserted checks 6 one by one through the check delivery passage 8 to the check conveyance path V. As indicated by the dashed lines in FIG. 2, the check delivery mechanism includes a pickup roller 16 and a pushing member 17. The pickup roller 16 delivers the check 6 inserted in the check supply portion 9 to the check delivery passage 8. The pushing member 17 pushes the check 6 against the pickup roller 16. Further, the check delivery mechanism includes a separation mechanism including a separation pad 18 and a separation portion 19 of a retard roller type. With this structure, the checks 6 to be delivered along the check delivery passage 8 are separated one by one and delivered to the check conveyance path 7.

As indicated by the dashed lines in FIG. 2, in the check conveyance path 7, a front-surface side contact image scanner 21 for reading a front-surface image of the check 6, a back-surface side contact image scanner 22 for reading a back-surface image of the check 6, a magnetic head 23 for reading magnetic ink characters on the check 6, and a printing mechanism 24 for printing "electronic settlement completed" or the like on a front surface of the check 6 are arranged in this order. Further, a conveyance mechanism (not illustrated) for conveying the check 6 along the check conveyance path 7 is incorporated. The conveyance mechanism may have a configuration including a motor for conveyance, a plurality of conveyance rollers arranged along the check conveyance path 7, and a drive belt for transmitting a rotation force of the motor to each of the conveyance rollers.

The check 6 delivered from the check supply portion 9 through the check delivery passage 8 is conveyed along the check conveyance path 7. During the conveyance, the front-surface image and the back-surface image are read, after which the magnetic ink character string 6A printed on the front surface 6*a* is read. Then, for example, the check 6, from which those pieces of information are read normally, is subjected to printing of "electronic settlement completed" or the like, after which the check 6 is distributed to and stored in the first storage pocket 13. Meanwhile, when a read error, read abnormality, or the like occurs for the check 6, the check 6 is not subjected to such printing, and is distributed to and stored in the second storage pocket 14.

Further, in the check storage portion 10, trailing edge parts of the first storage pocket 13 and the second storage pocket 14 are defined by a drawer portion 20, which is drawable backward. When the drawer portion 20 is drawn out backward from the state illustrated in FIG. 1, each of the first storage pocket 13 and the second storage pocket 14 extends in a front-and-back direction. Thus, a check 6 having a longer dimension can be received and stored.

Next, description is made of a detailed configuration of the check storage portion 10.

Figure 3:
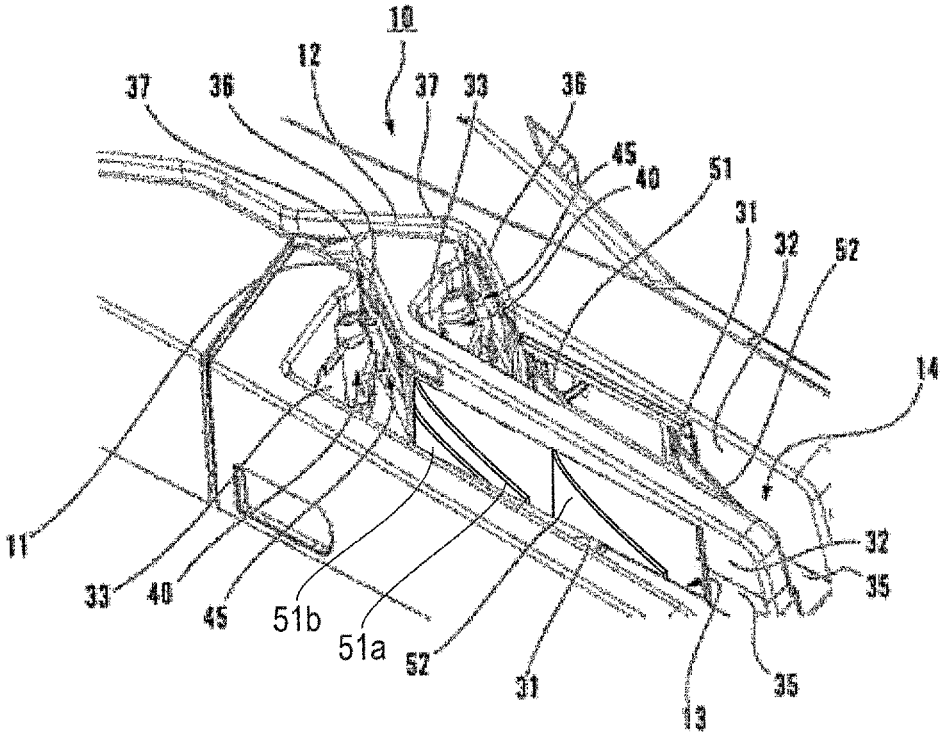
FIG. 3 is a schematic view illustrating a configuration of a medium processing device.

FIG. 3 is a schematic view (perspective view) illustrating the check storage portion serving as the medium storage portion.

As illustrated in FIG. 3, the check storage portion 10 includes the first branching passage 11, the second branching passage 12, the first storage pocket 13, and the second storage pocket 14. The first storage pocket 13 and the second storage pocket 14 couple to the downstream ends of the first branching passage 11 and the second branching passage 12. Note that, the first storage pocket 13 and the second storage pocket 14 have substantially the same configuration. Thus, description is made of the first storage pocket 13, and description of the second storage pocket 14 is omitted by denoting the same reference numerals to the corresponding parts.

The first storage pocket 13 is formed of a groove, which has a rectangular shape elongated in the front-and-back direction and a predetermined depth, and includes a first side plate 31 and a second side plate 32, which extend in parallel on right and left sides, a front end plate 33, and a bottom plate 35. An inclined guide surface 36 is formed at a front end part of the second side plate 32. The inclined guide surface 36 extends in a direction away from the first side plate 31 as approaching the front end plate 33. An upstream side of the inclined guide surface 36 continues to one inner wall surface 37 of the first branching passage 11.

A delivery roller 40 for delivering the check 6 to the first storage pocket 13 is arranged adjacent to the front end plate 33 on the inclined guide surface 36 side. On the one inner wall surface 37 of the first branching passage 11, which faces the delivery roller 40, a pressing roller 45 for pushing the check 6 against the delivery roller 40 is arranged.

A first pressurizing member 51*a* and a second pressurizing member 51*b*, which are plate-shaped, are provided in the first storage pocket 13. The first pressurizing member 51*a* and the second pressurizing member 51*b* guide the check 6 in a state of being delivered by the delivery roller 40 and the pressing roller 45 to the first side plate 31 side, pressurize (push) the check 6 after being delivered against the first side plate 31 side, and stack (hold) the check 6 in an upright state.

Further, on a downstream side of the first pressurizing member 51*a* and the second pressurizing member 51*b* in a storage direction of the checks 6, a third pressurizing member 52, which has a plate-shape and has the same pressurizing function as that described above, is arranged. Through setting of the first pressurizing member 51*a*, the second pressurizing member 51*b*, and the third pressurizing member 52, the number of positions at which the checks 6 stored in the first storage pocket 13 are pressurized are increased. Thus, the checks 6 can be pressurized more securely. Note that, the storage direction of the check 6 indicates a direction approaching the drawer portion 20 from the delivery roller 40 and the pressing roller 45.

Here, in order to exert the pressurizing function (urging function) by the first pressurizing member 51*a*, the second pressurizing member 51*b*, and the third pressurizing member 52, which is for pressurizing the check 6 in a direction of the first side plate 31, spring members are employed, for example. Therefore, the check 6 to be stored in the first storage pocket 13 is pressurized by the first pressurizing member 51*a*, the second pressurizing member 51*b*, and the third pressurizing member 52 in the direction of the first side plate 31.

Note that, in the exemplary embodiment, each of the springs employed as the first pressurizing member 51*a*, the second pressurizing member 51*b*, and the third pressurizing member 52 has substantially the same initial moment.

The first pressurizing member 51*a*, the second pressurizing member 51*b*, and the third pressurizing member 52 are mounted to be inclined backward toward the first side plate 31 at a predetermined angle with respect to the second side plate 32, and are rotated about an end part, which serves as a rotating center, of the second side plate 32 side in directions approaching and separating from the first side plate 31.

The first pressurizing member 51*a* and the second pressurizing member 51*b* are arranged to have the same axial center 50, and are rotatable about the axial center 50 serving as a rotating center (see FIG. 2). With this structure, the check processing device 1 can be reduced in size or simplified. Further, the first pressurizing member 51*a* and the second pressurizing member 51*b* are each arranged at different positions in an axial direction of the axial center 50.

Specifically, for a state in which the check 6 is not stored in the first storage pocket 13 (see FIG. 2), the second pressurizing member 51*b* is arranged in a stacking direction in which the checks 6 are stacked in the first storage pocket 13 with respect to the first pressurizing member 51*a*. In this case, the stacking direction indicates a direction extending from the first side plate 31 side to the second side plate 32 side. That is, for the state in which the check 6 is not stored in the first storage pocket 13, a distal end of the second pressurizing member 51*b* is arranged on the side closer to the second side plate 32 with respect to a distal end of the first pressurizing member 51*a*.

In other words, an angle formed by a surface of the second side plate 32 and a surface of the second pressurizing member 51*b*, which faces the surface of the second side plate 32, is smaller than an angle formed by the surface of the second side plate 32 and a surface of the first pressurizing member 51*a*, which faces the surface of the second side plate 32.

Further, when a stacking thickness of the checks 6 stored in the first storage pocket 13 is equal to or greater than a predetermined thickness, the first pressurizing member 51*a* and the second pressurizing member 51*b* cooperate to pressurize the checks 6 against the first side plate 31 side. That is, when the stacking thickness of the checks 6 stored in the first storage pocket 13 is equal to or greater than the predetermined thickness, a pressurizing force on the checks 6 is increased. Note that, the stacking thickness that is equal to or greater than the predetermined thickness is not limited by the number of the checks 6, and indicates a total thickness of such degree that the checks 6 cannot be sufficiently pressurized against the first side plate 31 side by the first pressurizing member 51*a* alone. Therefore, the stacking thickness can suitably be set based on a capacity of the first storage pocket 13 for storing the checks 6, the number of the checks 6 that can be stored in the first storage pocket 13, the spring constant used for the first pressurizing member 51*a* and the second pressurizing member 51*b*, and the like.

Next, description is made of an operation method of the check processing device 1. Note that, in the exemplary embodiment, description is made of a delivery operation of the check 6 to the first storage pocket 13.

FIG. 4A to FIG. 4D are explanatory views illustrating the operation method of the check processing device (medium processing device).

Figure 4A:
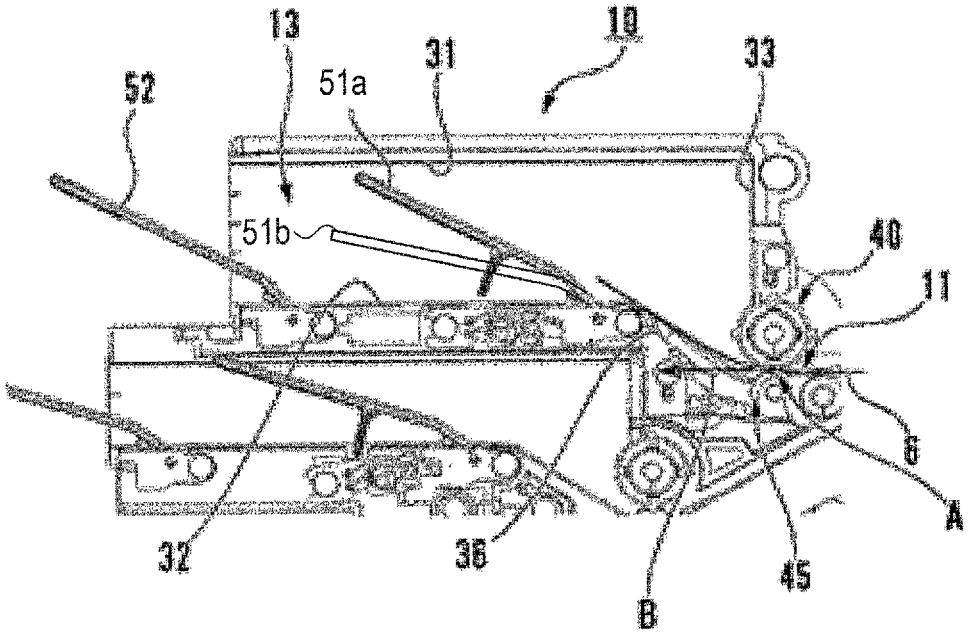
FIG. 4A is an explanatory view illustrating an operation method of a medium processing device.

As illustrated in FIG. 4A, first, when the check 6 is conveyed to the first branching passage 11, the check 6 is nipped between the delivery roller 40 that is rotating and the pressing roller 45, and is delivered to the first storage pocket 13. Specifically, the check 6 passing through a nip portion A is guided along the inclined guide surface 36, and advances in a delivery direction B (storage direction).

Figure 4B:
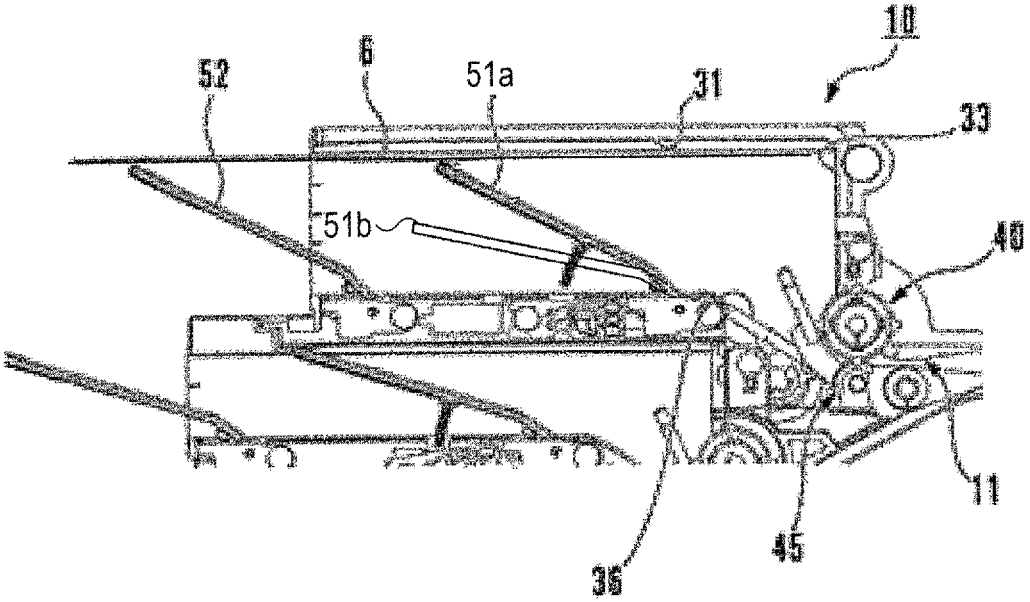
FIG. 4B is an explanatory view illustrating an operation method of a medium processing device.

Then, as illustrated in FIG. 4B, the check 6 enters the first storage pocket 13 from a corner portion of the inclined guide surface 36 to the first side plate 31 side, and is stored in the first storage pocket 13. At this time, the check 6 stored in the first storage pocket 13 is pressurized by the first pressurizing member 51*a*. The check 6 is pressurized by the first pressurizing member 51*a* and the third pressurizing member 52 to be held in the first storage pocket 13.

Figure 4C:
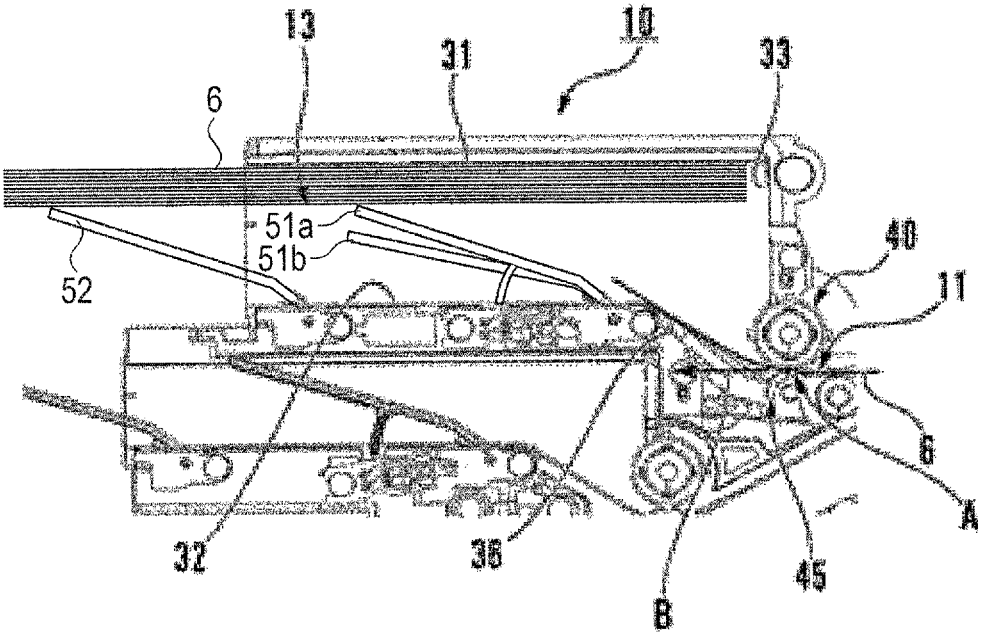
FIG. 4C is an explanatory view illustrating an operation method of a medium processing device.

Subsequently, as illustrated in FIG. 4C, when the checks 6 are further conveyed to and stored in the first storage pocket 13, the checks 6 are stacked in the stacking direction (direction from the first side plate 31 to the second side plate 32). At this time, the first pressurizing member 51*a* rotates about the axial center 50 and moves to the second side plate 32 side while pressurizing the checks 6.

Figure 4D:
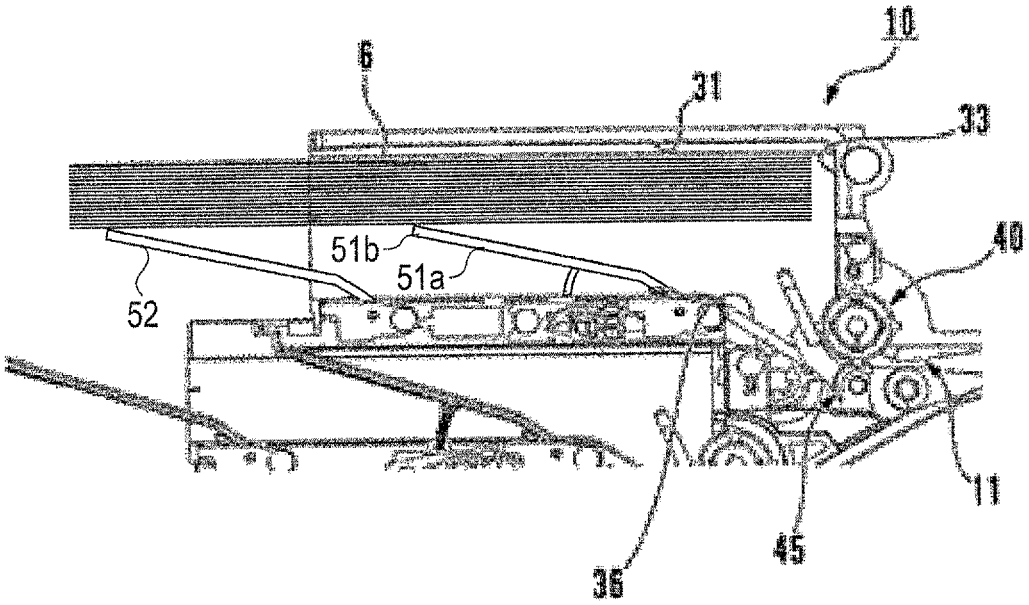
FIG. 4D is an explanatory view illustrating an operation method of a medium processing device.

Subsequently, as illustrated in FIG. 4D, when the checks 6 are further conveyed to and stored in the first storage pocket 13 and the stacking thickness of the checks 6 stored in the first storage pocket 13 becomes equal to or greater than the predetermined thickness, the first pressurizing member 51*a* finally arrives at a position which is the same as the position of the second pressurizing member 51*b*. Accordingly, the first pressurizing member 51*a* and the second pressurizing member 51*b* cooperate to pressurize the checks 6.

That is, in a case where the stacking thickness of the checks 6 stacked in the first storage pocket 13 is relatively thin, a plurality of checks 6 that are staked can be sufficiently pressurized against the first side plate 31 by the first pressurizing member 51*a* alone. However, when the stacking thickness of the checks 6 stacked in the first storage pocket 13 is gradually increased, a load applied to the first pressurizing member 51*a* is also increased. Accordingly, the checks 6 that are stacked are not easily pressurized sufficiently against the first side plate 31 side. As a result, for example, an upper-most check of the checks 6 conveyed to the first storage pocket 13 may be stored to be further deviated to the downstream side in the storage direction due to insufficient pressurization by the first pressurizing member 51*a*. In this case, an upstream edge of the check 6 in the storage direction and a downstream edge of the check 6 that is newly-conveyed are liable to collide with each other and cause a medium jam.

As a counter measure, in the exemplary embodiment, as illustrated in FIG. 4D, when the stacking thickness of the checks 6 stacked in the first storage pocket 13 becomes equal to or greater than the predetermined thickness, the first pressurizing member 51*a* and the second pressurizing member 51*b* pressurize the checks 6. That is, the checks 6 are pressurized with a pressurizing force equal to or greater than the pressurizing force for pressurizing the checks 6 only by the first pressurizing member 51*a*. For example, the pressurizing force exerted by the first pressurizing member 51*a* and the second pressurizing member 51*b* is nearly twice the pressurizing force exerted by the first pressurizing member 51*a*. Therefore, the checks 6 can be securely pressurized according to the stacking thickness of the checks 6 stored in the first storage pocket 13.

As illustrated in FIG. 4A to FIG. 4C, at an initial state, the arrangement positions of the first pressurizing member 51*a* and the second pressurizing member 51*b* are different. In other words, the first pressurizing member 51*a* and the second pressurizing member 51*b* are different in timing for pressurizing the checks 6. Specifically, first, the checks 6 are pressurized only by the first pressurizing member 51*a*. When the stacking thickness of the checks 6 becomes equal to or greater than the predetermined thickness (see FIG. 4D), the first pressurizing member 51*a* and the second pressurizing member 51*b* cooperate to pressurize the checks 6 with a greater force.

That is, at the initial state, the checks 6 are pressurized only by the first pressurizing member 51*a* with a relatively small force. Accordingly, deformation such as buckling of the check 6 that is conveyed can be suppressed, and a conveyance property and storability can be improved. Meanwhile, when the stacking thickness of the checks 6 is equal to or greater than the predetermined thickness, the checks 6 are not easily pressed down by the first pressurizing member 51*a* alone. Thus, the checks 6 are pressurized by the first pressurizing member 51*a* and the second pressurizing member 51*b*, improving the conveyance property and the storability. That is, by changing the pressurizing force in a stepwise manner according to the stacking thickness of the checks 6 stored and stacked in the first storage pocket 13, the checks 6 can be securely stored.

According to the exemplary embodiment, the following advantages can be obtained.

The pressurizing force is changeable in a stepwise manner according to the stacking thickness of the checks 6 stacked in the first storage pocket 13. That is, when the stacking thickness of the checks 6 stacked in the first storage pocket 13 is smaller than the predetermined thickness, the checks 6 are pressurized only by the first pressurizing member 51*a*. Thus, the deformation such as buckling of the check 6 can be suppressed, and the checks 6 can be efficiently stored in the first storage pocket 13. Meanwhile, when the stacking thickness of the checks 6 stacked in the first storage pocket 13 is equal to or greater than the predetermined thickness, the checks 6 are pressurized by the first pressurizing member 51*a* and the second pressurizing member 51*b*. Thus, the force for pressurizing the checks 6 is increased, and hence the checks 6 can be securely stored. Accordingly, occurrence of a medium jam and the like can be suppressed.

Note that, the invention is not limited to the above-described exemplary embodiment, and various changes and improvements can be made to the above-described exemplary embodiment. Modified examples are described below.

Modified Example 1

In the above-described exemplary embodiment, the first pressurizing member 51*a* and the second pressurizing member 51*b* are provided only on the upstream side in the storage direction, but the invention is not limited to this configuration. For example, the third pressurizing member 52 may be divided, and a plurality of (two) pressurizing members may be provided similarly to the above-described first pressurizing member 51*a* and second pressurizing member 51*b*. With this configuration, the entire checks 6 can be efficiently pressurized.

Further, one pressurizing member may be provided on the upstream side in the storage direction, and a plurality of pressurizing members may be provided on the downstream side in the storage direction. Even with this configuration, similar advantages as described above can be obtained.

Modified Example 2

In the above-described exemplary embodiment, description is made of the first storage pocket 13 serving as the medium storage portion. However, the second storage pocket 14 may have the same configuration as the first storage pocket 13. With this configuration, in the first storage pocket 13 and the second storage pocket 14, occurrence of a medium jam of the checks 6 can be suppressed.

Modified Example 3

In the above-described exemplary embodiment, the first pressurizing member 51*a* and the second pressurizing member 51*b* are each arranged on the upper side and the lower side on the same axial center 50. However, the invention is not limited to this configuration. For example, when the first pressurizing member 51*a* and the second pressurizing member 51*b* are moved by being rotated about the axial center 50, a part of the first pressurizing member 51*a* and a part of the second pressurizing member 51*b* may be brought into contact with each other.

Figure 5:
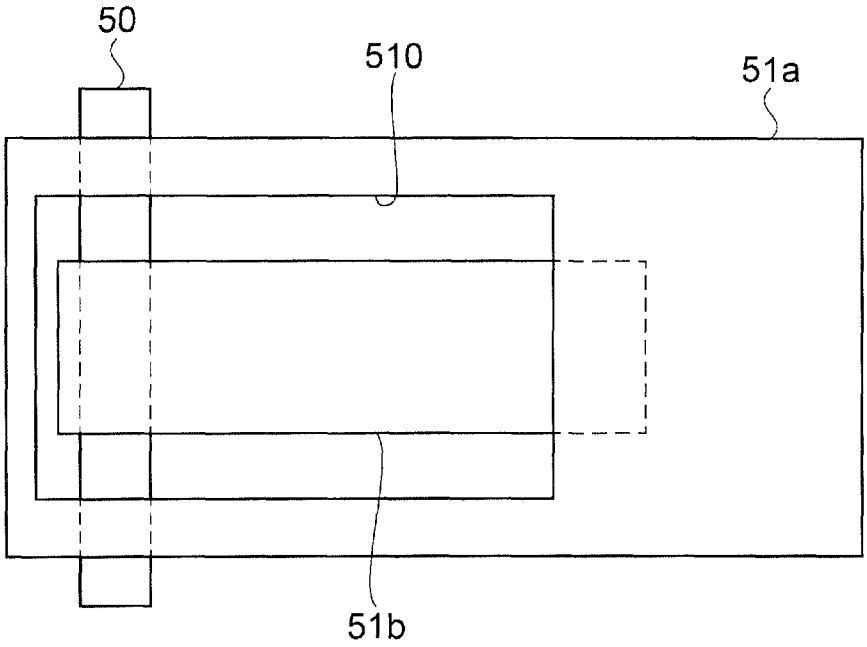
FIG. 5 a schematic view illustrating a configuration of a medium processing device in a modified example.

FIG. 5 is a schematic view illustrating the configuration of the medium processing device in the modified example, and illustrates the configuration of the first pressurizing member 51*a* and the second pressurizing member 51*b*. Note that FIG.

5 is a view from the first side plate 31 side to the second side plate side. As illustrated in FIG. 5, the first pressurizing member 51*a* and the second pressurizing member 51*b* are arranged on the same axial center 50. Further, an opening 510 is formed in the first pressurizing member 51*a* (at a position including the axial center 50), and the second pressurizing member 51*b* is arranged at a position corresponding to the opening 510 of the first pressurizing member 51*a*. Further, one end of the second pressurizing member 51*b* in the longitudinal direction is formed to overlap with a part of the first pressurizing member 51*a*.

Further, for the state in which the checks 6 are not stored in the first storage pocket 13, the second pressurizing member 51*b* is arranged in the stacking direction in which the checks 6 are stacked in the first storage pocket 13 with respect to the first pressurizing member 51*a*. Further, when the stacking thickness of the checks 6 stored in the first storage pocket 13 is equal to or greater than the predetermined thickness, the second pressurizing member 51*b* pressurizes the first pressurizing member 51*a*. Accordingly, the first pressurizing member 51*a* and the second pressurizing member 51*b* cooperate to pressurize the checks 6. Even with this configuration, similar advantages as described above can be obtained.

This application claims priority under 35 U.S.C. § 119 to Japanese Patent Application No. 2017-218020, filed Nov. 13, 2017. The entire disclosure of Japanese Patent Application No. 2017-218020 is hereby incorporated herein by reference.

What is claimed is:

1. A medium processing device comprising:

a medium storage portion configured to stack sheet-shaped media to store the sheet-shaped media;

a first pressurizing member configured to apply pressure to the sheet-shaped media stored in the medium storage portion and hold the sheet-shaped media in an upright state; and a second pressurizing member configured to apply pressure to the sheet-shaped media in cooperation with the first pressurizing member when a stacking thickness of the sheet-shaped media stored in the medium storage portion is equal to or greater than a predetermined thickness and hold the sheet-shaped media in the upright state, wherein the second pressurizing member does not apply pressure to the sheet-shaped media when the stacking thickness of the sheet-shaped media stored in the medium storage portion is less than the predetermined thickness, and a portion of the first pressurizing member and a portion of the second pressurizing member are arranged to overlap each other in a stacking direction in which the sheet-shaped media are stacked in the medium storage portion.

2. The medium processing device according to claim 1, wherein the first pressurizing member and the second pressurizing member are arranged on a same axial center, and the first pressurizing member and the second pressurizing member are each arranged at different positions in an axial direction of the axial center.

3. The medium processing device according to claim 1, wherein, for a state in which the sheet-shaped media are not stored in the medium storage portion, the second pressurizing member is arranged below the first pressurizing member in the stacking direction.

4. The medium processing device according to claim 1, further comprising a third pressurizing member configured to apply pressure to the sheet-shaped media on a downstream side in a storage direction of the sheet-shaped media with respect to the first pressurizing member and the second pressurizing member.

5. The medium processing device according to claim 1, wherein the first pressurizing member and the second pressurizing member are configured to apply pressure to the sheet-shaped media according to the stacking thickness of the sheet-shaped media.

6. The medium processing device according to claim 1, wherein a pressurizing force for pressurizing the sheet-shaped media is larger when the stacking thickness of the sheet-shaped media stored in the medium storage portion is equal to or greater than the predetermined thickness compared to when the stacking thickness of the sheet-shaped media stored in the medium storage portion is less than the predetermined thickness.

7. The medium processing device according to claim 1, wherein a pressurizing force for pressurizing the sheet-shaped media is increased in a stepwise manner according to the stacking thickness of the sheet-shaped media.

8. The medium processing device according to claim 1, wherein, when the stacking thickness of the sheet-shaped media stored in the medium storage portion is less than the predetermined thickness, an angle between a bottom wall of the medium storage portion and the second pressurizing member is smaller than an angle between the bottom wall of the medium storage portion and the first pressurizing member.

9. The medium processing device according to claim 1, wherein the first pressurizing member and the second pressurizing member each comprise a plate.

10. The medium processing device according to claim 1, further comprising a media conveyance path along which the sheet-shaped media is conveyed to the medium storage portion.

11. The medium processing device according to claim 10, further comprising a media delivery mechanism configured to deliver a plurality of the sheet-shaped media one by one to the media conveyance path.

12. The medium processing device according to claim 10, further comprising an image scanner configured to read the sheet-shaped media along the media conveyance path.

13. The medium processing device according to claim 10, further comprising a printer configured to print onto the sheet-shaped media along the media conveyance path.

14. The medium processing device according to claim 1, further comprising a delivery roller configured to deliver the sheet-shaped media to the medium storage portion.

* * * * *